United States Patent [19]

Kuna et al.

[11] Patent Number: 4,988,099

[45] Date of Patent: Jan. 29, 1991

[54] MOVING CHARACTER ACTION GAME

[75] Inventors: Wayne A. Kuna, River Forest; Ralph J. Kulesza, Chicago, both of Ill.

[73] Assignee: Wayne Kuna & Associates, Oak Park, Ill.

[21] Appl. No.: 466,063

[22] Filed: Jan. 16, 1990

[51] Int. Cl.[5] ..... A63F 9/00

[52] U.S. Cl. ..... 273/1 GF; 273/359

[58] Field of Search ..... 273/1 GF, 1 GC, 1 GD, 273/359, 366–370

[56] References Cited

U.S. PATENT DOCUMENTS

| | | | |
|---|---|---|---|
| 3,391,936 | 7/1968 | Grimes | 273/359 X |
| 3,941,384 | 3/1976 | Wopschall | 273/359 X |
| 4,119,312 | 10/1978 | Todokoro | 273/120 R X |
| 4,412,682 | 11/1983 | Rehkemper et al. | 273/1 GG |
| 4,804,192 | 2/1989 | Matsumoto et al. | 273/370 X |

*Primary Examiner*—Paul E. Shapiro

*Attorney, Agent, or Firm*—John S. Pacocha

[57] ABSTRACT

A game involving the insertion of items into an open receptacle connected to an elongated member that is removably mounted on a hollow body containing a mechanism for effecting movement of the body relative to a playing surface. As the body moves about the playing surface, the elongated member, which is sufficient rigid to support the receptacle spaced from the body, is sufficiently flexible so that the receptacle moves asynchronously with respect to the body as a result of the movement of the body. The elongated member is hollow and receives items through an opening in the back of the receptacle. To facilitate storage of the game and emptying of the items from the elongated member, it is removably mounted to the body. Players are provided with a device to use in inserting the items into the receptacle and try to be the first to dispose of the items allocated to them.

19 Claims, 2 Drawing Sheets

Fig 1

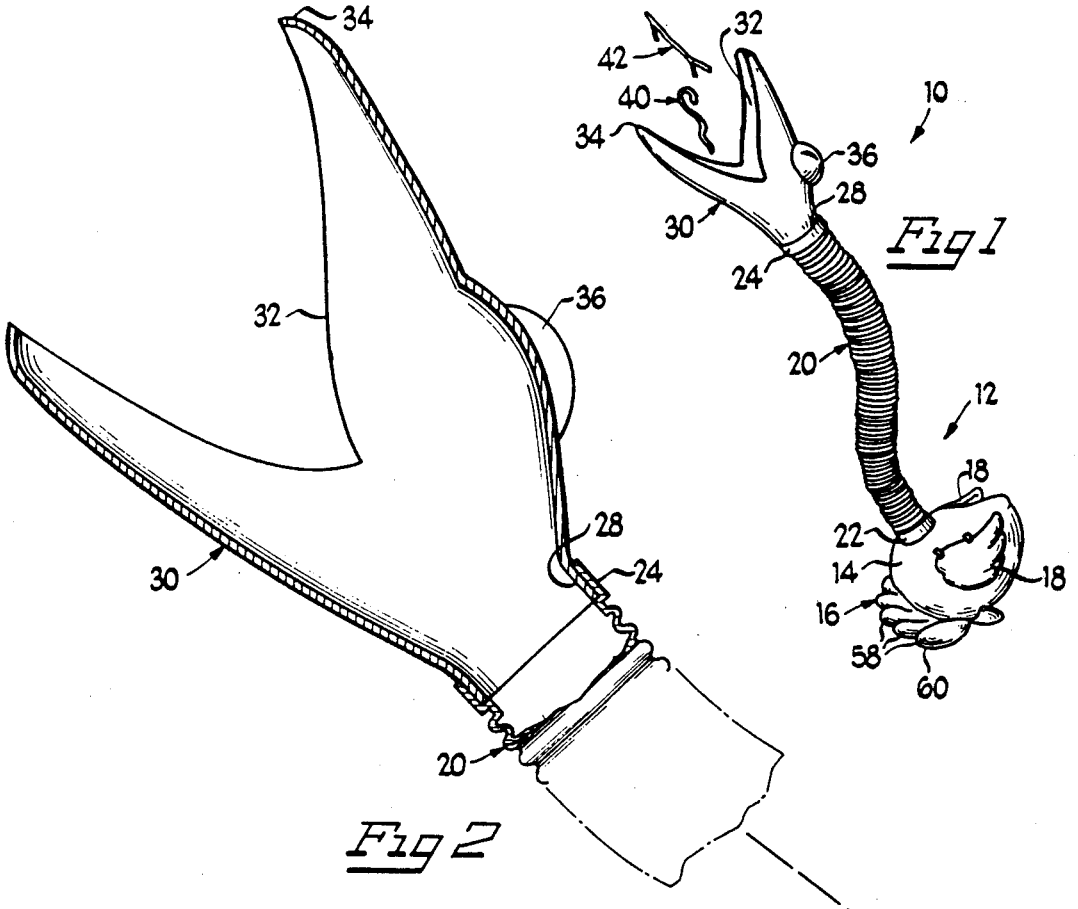
Fig 1
Fig 2
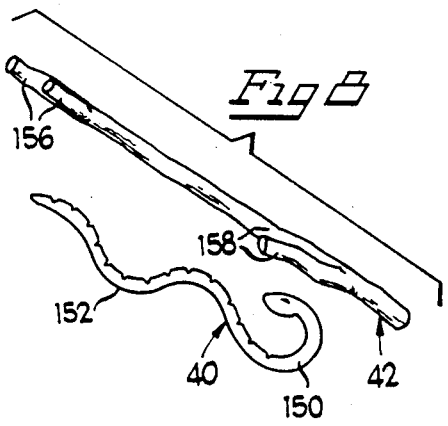
Fig 8
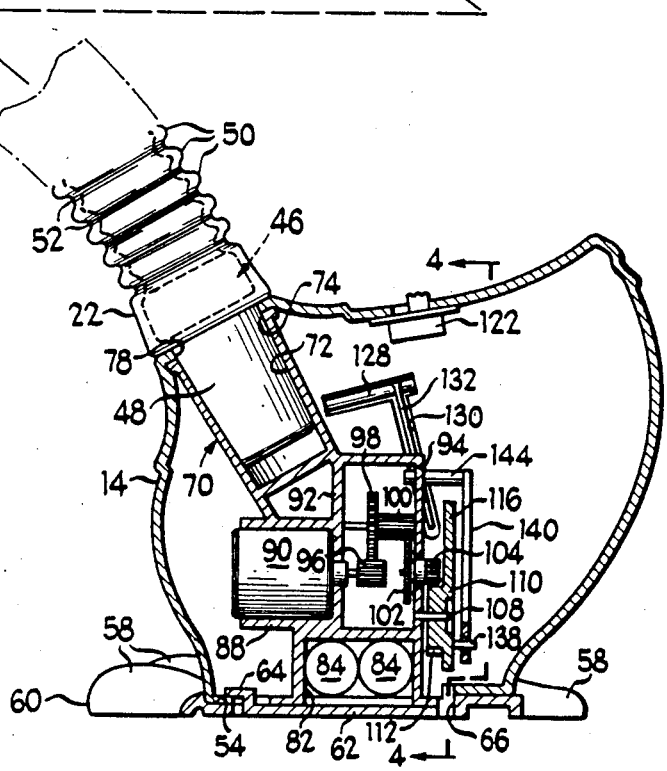

MOVING CHARACTER ACTION GAME

BACKGROUND OF THE INVENTION

1. Field of the Invention

This invention relates generally to action games and more particularly to action games in which players attempt to feed a simulated character with items provided in the game.

2. Background Art

Games which require players to feed simulated characters are very popular with children. Two examples of such games are Milton Bradley Company's HUNGRY HUNGRY HIPPOS and STUFF YER FACE, which are disclosed in Todokoro U.S. Pat. No. 4,119,312 issued Oct. 10, 1978 and Rehkemper et al. U.S. Pat. No. 4,412,682 issued Nov. 1, 1983, respectively. There remains, however, a need for games in which children feed items to a simulated character, particularly an animated one with an entertaining movement that also makes feeding of the character more challenging.

SUMMARY OF THE INVENTION

The present invention is concerned with providing a game for a number of players in which each player tries to feed a number of items into an open receptacle that is gyrating about in an erratic manner. These and other objects and advantages of the invention are achieved by providing a hollow body that is adapted to be supported upon a playing surface with a mechanism inside the body for effecting movement of it relative to the playing surface, an elongated member is mounted at one end to the body and is connected at the other end to the back end of a receptacle with an opening in its front end, the elongated member is sufficiently rigid to support the receptacle spaced from the body while being sufficient flexible so that the receptacle moves asynchronously with respect to the body as a result of the movement of the body relative to the playing surface making it challenging for players to deposit the items into the opening of the receptacle. Further challenge results from requiring the players to utilize a device that is provided for depositing the items into the opening of the receptacle. The elongated member is hollow and is open at the end connected to the receptacle, the back end of which is also open so that they are in item transferring communication with each other while the end of the hollow elongated member mounted to the body is closed. Removably mounting the elongated member to the body facilitates emptying of the deposited items. Entertaining and challenging movement of the receptacle is enhanced by making the elongated member approximately three times as long as the height of the body. Facilitating support of the body and further enhancing the resulting movement of the receptacle is a foot portion secured to the body adjacent its lower end while the elongated member is mounted adjacent the upper end of the body and extends generally upwardly from the body. The elongated member is corrugated such that cross sections generally transverse to its elongated direction are substantially circular and the end of the elongated member mounted to the body is of a smaller diameter than the end connected to the receptacle. Additional entertaining movement is provided by appendages carried by the body for movement relative to the body which is effected by the same mechanism effecting movement of the body relative to the playing surface, namely, a motor driven cam that periodically engages the playing surface and which carries a link that effects pivotal movement of the appendages relative to the body.

BRIEF DESCRIPTION OF THE DRAWINGS

For a better understanding of the present invention, reference by be had to the accompanying drawings in which:

FIG. 1 is a perspective view of a game embodying the present invention;

FIG. 2 shows an enlarged scale sectional view taken generally vertically through part of the invention shown in FIG. 1, which has been partially broken away for ease of illustration;

FIG. 8 is an enlarged scale perspective view of additional parts of the invention.

DETAIL DESCRIPTION OF THE PREFERRED EMBODIMENT

Figure 4:
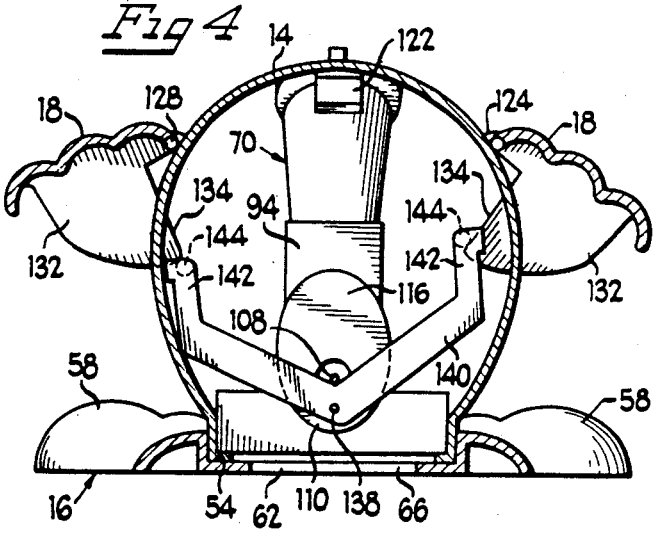
FIG. 4 is a sectional view taken generally along line 4—4 of FIG. 2.

Referring now to the drawings in which like parts are designated by like reference numerals throughout the several views, FIG. 1 shows a game 10 including a simulated bird character 12 having a hollow body 14. At the lower end of body 14 is a foot portion 16 which assists in supporting body 14 upon a playing surface and also assists with respect to effecting entertaining movement of the body relative to the playing surface. Mounted for pivotal movement relative to body 14 are a pair of wings 18, one on each side of body 14.

Extending upwardly from body 14 is an elongated necklike member 20 in the form of a hollow corrugated tube made of low density polyethylene. Member 20 has a smaller diameter at one end 22 than at the other end 24. Smaller diameter end 22 is mounted to body 14 while larger diameter end 24 is connected to a back end 28 of a receptacle 30. The receptacle is formed to simulate the head of a bird-like creature having an opening 32 simulating an open mouth or beak at its front end 34. A simulated eye 36 is provided to enhance the bird-like creature head appearance of receptacle 30.

Included in the game are a plurality of worm-like items 40 (only one of which is shown for ease of illustration) for insertion into opening 32 of the receptacle. To make insertion of items 40 into open mouth 32 more challenging, a forked stick-like device 42 is also provided as part of the game.

As it is best shown in FIG. 2, back end 28 of receptacle 30 is open and is in worm-like item 40 communication through open end 24 of neck-like elongated member 20 with the interior of member 20. Smaller diameter end 22 of member 20 is formed with a plug 46 having a tapered outwardly projecting end 48. Plug 46 both closes the lower mounted end of neck-like member 20 and provides for removable mounting of elongated member 20 to body 14.

Elongated member 20 is conveniently about fifteen inches long and is corrugated to form a series of alternating, evenly spaced apart raised rings 50 and depressed grooves 52. In cross section generally transverse to the elongated direction of member 20 each ring 50 and each groove 52 forms a circle that is concentric with and axially spaced apart from its adjoining respective ring or groove. One of the adjoining rings on one side is of a slightly smaller diameter and the other which is of a slightly greater diameter. Adjoining grooves 52 are related to each other in the same manner as adjoining rings 50 are related to each other. Accordingly, elongated member 20 tapers from its larger diameter end 24 down to its smaller diameter end 22.

Figure 5:
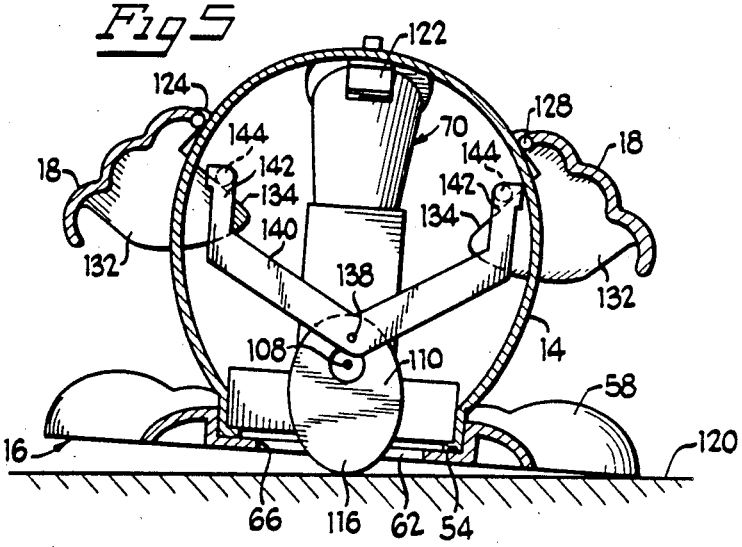
FIG. 5 is a sectional view similar to that of FIG. 4 but showing the part of the invention illustrated in FIG. 1 in movement relative to the playing surface.
Figure 6:
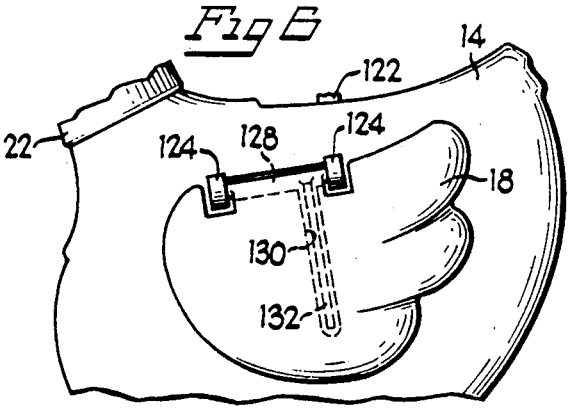
FIG. 6 is a fragmentary elevational view of one side of the part of the invention shown in FIGS. 1–5.
Figure 7:
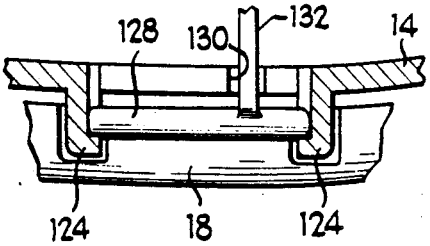
FIG. 7 is an enlarged scale fragmentary view, partially in section, showing the mounting of an appendage to the body of the part of the invention shown in FIGS. 1–6.

Body 14 is preferably molded of plastic such as a high impact polystyrene and is approximately five inches high. Foot portion 16 which is made of low density polyethylene is secured to the bottom of body 14 by suitable fasteners, adhesives, heat staking or the like. The addition of foot portion 16 provides a broader base for body 14. As is illustrated in FIGS. 2, 4 and 5, foot portion 16 is formed with a central depressed area 54 into which the bottom of body 14 nests. Extending outwardly from the central area are a plurality of toe-like projections or lobes 58 each of which has a rounded or curved front end 60. Generally in the middle of central area 54 is a cover 62 that is pivotal, by virtue of a living hinge, between an open position permitting access to the interior of hollow body 14 and the closed position shown in FIG. 2. Cover 62 is latched in the closed position by means of an integral tab 64 which engages the interior of body 14. Toward the back of foot portion 16 is a generally rectangular slot 66.

Secured within the interior of hollow body 14 is a housing 70 which is seated upon the bottom of the interior of body 14. Housing 70 includes a tapered socket 72 having an open end 74 that is aligned with an opening 78 in the upper part of hollow body 14. Tapered plug end 48 is inserted through opening 78 into socket 72 in a frictionally interfering fit to removably mount neck-like member 20 to body 14. Removably mounting member 20 to body 14 facilitates not only emptying of items 40 deposited into member 20 through receptacle 30 but also disassembly for storage.

A compartment 82 for a pair of batteries 84 is provided by housing 70. Access to compartment 82 for changing the batteries as needed is obtained by opening latched cover 62. Housing 70 also provides a seat 88 for a motor 90 as well as spaced apart walls 92 and 94. Motor 90 has a drive shaft gear 96 that drivenly engages a spur gear 98 which rotates coaxially with pinion 100. Both spur gear 98 and pinion 100 are journaled for rotation between spaced apart walls 92 and 94.

Figure 3:
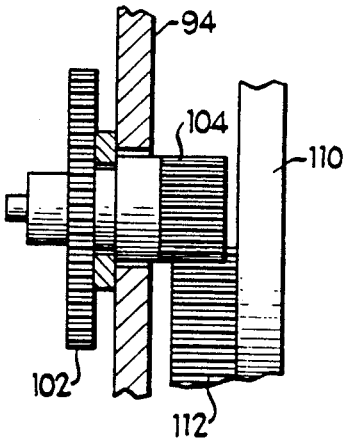
FIG. 3 is an enlarged scale fragmentary view of a portion of the drive mechanism shown in FIG. 2.

Pinion 100 is in driving engagement with a spur gear 102 that is supported for rotation in wall 94 as is better illustrated in the enlarged scale fragmentary view of FIG. 3. Coaxially rotating with spur gear 102 is a pinion 104 that is disposed on the opposite side of wall 94 from spur gear 102. Mounted for rotation about a stub shaft 108 extending outwardly from wall 94 is a cam 110. Again, as is perhaps better shown in the enlarged scale fragmentary view of FIG. 3, cam 110 includes an integrally formed gear 112 that is drivenly engaged by pinion 104 causing cam 110 to be rotated about stub shaft 108.

Cam 110 includes a single lobe 116 that periodically extends out of the interior of hollow body 14 through opening 66 and projects below the bottom of the body and foot portion 16 to engage a playing surface 120. Every time lobe 116 of cam 110 engages playing surface 120, bird-like character 12 is raised slightly and pivoted about the curved front end of one of toes 58 of foot portion 16. Such periodic engagement of lobe 116 with playing surface 120 causes bird-like character 12 to gyrate or wobble about playing surface 120 in a somewhat irregular manner. Because of receptacle 30 being supported by elongated member 20 which is corrugated and about three times as long as body 14 is high, such wobbling about of the body 14 with respect to the playing surface results in erratic, asynchronous movement of receptacle 30 with respect to body 14. A number of players each trying, simultaneously or in separate turns, to deposit items such as simulated worms 40 into the open mouth 32 of receptacle 30 provides challenging and entertaining game play.

Body 14 carries an on-off switch 122, actuation of which is accessible from the outside of the body. Switch 122 is connected through suitable wiring (not shown) to batteries 84 and motor 90 so that players may selectively turn the motor on and off, as desired.

The entertaining movement of bird-like character 12 is enhanced by the flapping of wings 18. A pair of trunnions 124 is integrally formed with body 14 on each side of the body. Each of the wings is formed with an integral T-shaped bar 128 that is seated between trunnions 124. Accordingly, each of the wings may pivot toward and away from body 14 about the axis of T-shaped bar 128. Body 14 also includes a generally top to bottom oriented slot 130 disposed between trunnions 124 with the length of slot 130 being substantially transverse to the axis of T-shaped bar 128. Also integrally formed as part of each wing 18 is a fin 132 that extends inwardly toward body 14 from the body side of each wing 18. Fin 132 fits through slot 130 into hollow body 14. Along its edge, each fin 132 has a cam surface 134.

Cam 110 includes an outwardly facing pin 138 on which a bifurcated link arm 140 is mounted. Pin 138 fits loosely into approximately the center of link arm 140 so that the link arm 140 substantially maintains the angular orientation illustrated in FIGS. 4 and 5 regardless of the rotational position of pin 138.

Link arm 140 has two free ends 142 each of which carries a rod 144 that is disposed so that the axis of each rod is substantially parallel to the axis of pin 138. Gravity, or the weight of each wing 18, urges its respective fin 132 dowardly and inwardly through slot 130 into engagement with a respective rod 144. Accordingly, as cam 110 and pin 138 rotate, bifurcated link arm 140 moves between the lowermost position illustrated in FIG. 4 and the uppermost position illustrated in FIG. 5.

With link arm 140 in its uppermost position, each of wings 18 move, by gravitational force in toward body 14. As link arm 140 moves to its lowermost position, each of rods 144 engage a respective edge 134 of fin 132 pushing the respective fin, and its wing 18, away from body 14. As is shown on FIGS. 4 and 5, when lobe 116 of cam 110 is at the top of its cycle, bifurcated link arm 140 is in its lowermost position and accordingly, wings 18 are farthest away from body 14. However, as lobe 116 extends out through slot 66 and engages playing surface 120, bifurcated link arm 140 moves to its uppermost position and wings 18 move down toward body 14. Accordingly, the appearance is created that the thrust resulting from the downward flapping of wings 18 has caused bird-like creature 12 to lift off of playing surface 120.

Worm-like items 40 are, as better shown in FIG. 8, formed with a hook shaped end 150 and a serpentine body 152. Stick-like device 42 is provided with a fork 156 at one end and another fork 158 adjacent the other end. Players may use either fork 156 or 158 to engage worm-like item 40, preferably by hook shaped end 150, to carry item 40 for depositing into the opening 32 of head or receptacle 30 that is gyrating about atop corrugated, elongated neck-like member 20 as body 14 is periodically moved about the playing surface a result of the engagement of motor driven cam lobe 116.

While a particular embodiment in the present invention has been shown and described, other changes and modifications will occur to those skilled in the art. It is intended in the following claims to cover all such changes and modifications as fall within the true spirit and scope of the present invention.

What is claimed as new and desired to be secured by Letters Patent is:

1. A game comprising in combination:

a hollow body adapted to be supported upon a playing surface;

means within the hollow body for effecting movement of the body relative to the playing surface;

an elongated member having opposed ends;

one of the ends of the elongated member being mounted to the body;

a receptacle having front and back ends;

an opening in the front end of the receptacle;

the back end of the receptacle being connected to the other end of the elongated member;

the elongated member being sufficiently rigid to support the receptacle spaced from the body while being sufficiently flexible so that the receptacle moves asynchronously with respect to the body as a result of the movement of the body relative to the playing surface; and items for depositing into the opening of the receptacle.

2. The game of claim 1 including a device to use in depositing the items into the opening of the receptacle.

3. The game of claim 1 in which:

the elongated member is hollow;

the other end of the elongated member is open; and the back end of the receptacle is in item transferring communication with the other end of the hollow elongated member.

4. The game of claim 3 in which the hollow elongated member is closed at the one end.

5. The game of claim 4 including:

a plug which closes the one end of the hollow elongated member and extends outwardly beyond the one end; and a socket in the body which receives the plug in a frictionally interfering fit to removably mount the elongated member to the body.

6. The game of claim 3 in which the one end of the elongated member is removably mounted to the body.

7. The game of claim 6 in which the hollow elongated member is closed at the one end.

8. The game of claim 1 in which;

the body is of a predetermined height; and the elongated member is approximately three times as long as the height of the body.

9. The game of claim 1 including:

a foot portion;

the body having an upper end and a lower end;

the one end of the elongated member being mounted to the body adjacent the upper end; and the foot portion being secured to the body adjacent the lower end.

10. The game of claim 9 in which the elongated member extends generally upwardly from the body.

11. The game of claim 1 in which the elongated member is substantially circular in any cross section generally transverse to the elongated direction.

12. The game of claim 11 in which the one end has a smaller diameter than the other end.

13. The game of claim 1 in which the one end has a smaller diameter than the other end.

14. The game of claim 1 in which the elongated member is corrugated throughout most of its length.

15. The game of claim 1 including:

one or more appendages carried by the body for movement relative to the body; and the means effecting movement of the body relative to the playing surface also effecting movement of the appendages relative to the body.

16. The game of claim 15 in which the means effecting movement of the body relative to the playing surface includes a motor driven cam that periodically engages the playing surface.

17. The game of claim 16 in which:

the appendages are mounted for pivotal movement relative to the body; and the cam carries a link which periodically effects the pivotal movement of the appendages relative to the body.

18. The game of claim 17 in which:

the appendages move toward the body by force of gravity; and the link periodically moves the appendages away from the body.

19. The game of claim 1 in which the means effecting movement of the body relative to the playing surface includes a motor driven cam that periodically engages the playing surface.

* * * * *